United States Patent [19]

Kwast

[11] Patent Number: 4,721,393

[45] Date of Patent: Jan. 26, 1988

[54] RATIO MIX CONTAINER

[76] Inventor: Gerald M. Kwast, 7920 Skillings Dr., Corvallis, Oreg. 97330

[21] Appl. No.: 944,520

[22] Filed: Dec. 22, 1986

[51] Int. Cl.[4] ..... B01F 13/00

[52] U.S. Cl. ..... 366/341; 73/426; 73/427; 220/85 R; 366/150; 366/349

[58] Field of Search ..... 366/76, 30, 150, 160, 366/182, 341, 349; 220/85 R, 86 R, 85 SP; 141/95, 105; 73/426, 427, 429; 222/158; 137/576

[56] References Cited

U.S. PATENT DOCUMENTS

| | | | |
|---|---|---|---|
| 2,712,396 | 7/1955 | Mowat | 73/426 |
| 3,870,147 | 3/1975 | Orth | 366/341 X |
| 3,948,105 | 4/1976 | Johnson, Jr. | 73/427 |
| 4,135,404 | 1/1979 | Butler, Jr. | 73/426 |
| 4,292,846 | 10/1981 | Barnett | 220/85 SP X |
| 4,480,470 | 11/1984 | Tussing | 73/427 |
| 4,587,846 | 5/1986 | Coma Julia | 73/426 X |

FOREIGN PATENT DOCUMENTS

| | | | |
|---|---|---|---|
| 3431720 | 12/1985 | Fed. Rep. of Germany | 73/426 |

*Primary Examiner*—Timothy F. Simone

*Attorney, Agent, or Firm*—Fleit, Jacobson, Cohn & Price

[57] ABSTRACT

An upstanding container including an upwardly opening fill neck is provided. An upstanding tubular compartment assembly is downwardly removably positionable within the container through the fill neck and includes upper and lower openings communicating the interior of the assembly with the interior of the container exteriorly of the assembly. The assembly includes structure by which the upper and lower openings may be selectively opened and closed and upstanding internal liquid volume displacement structure is removably and downwardly insertable into the assembly for selectively varying the internal volume thereof in order to enale different ratio mixes of two liquids to be formed within the container.

13 Claims, 11 Drawing Figures

FIG. 1
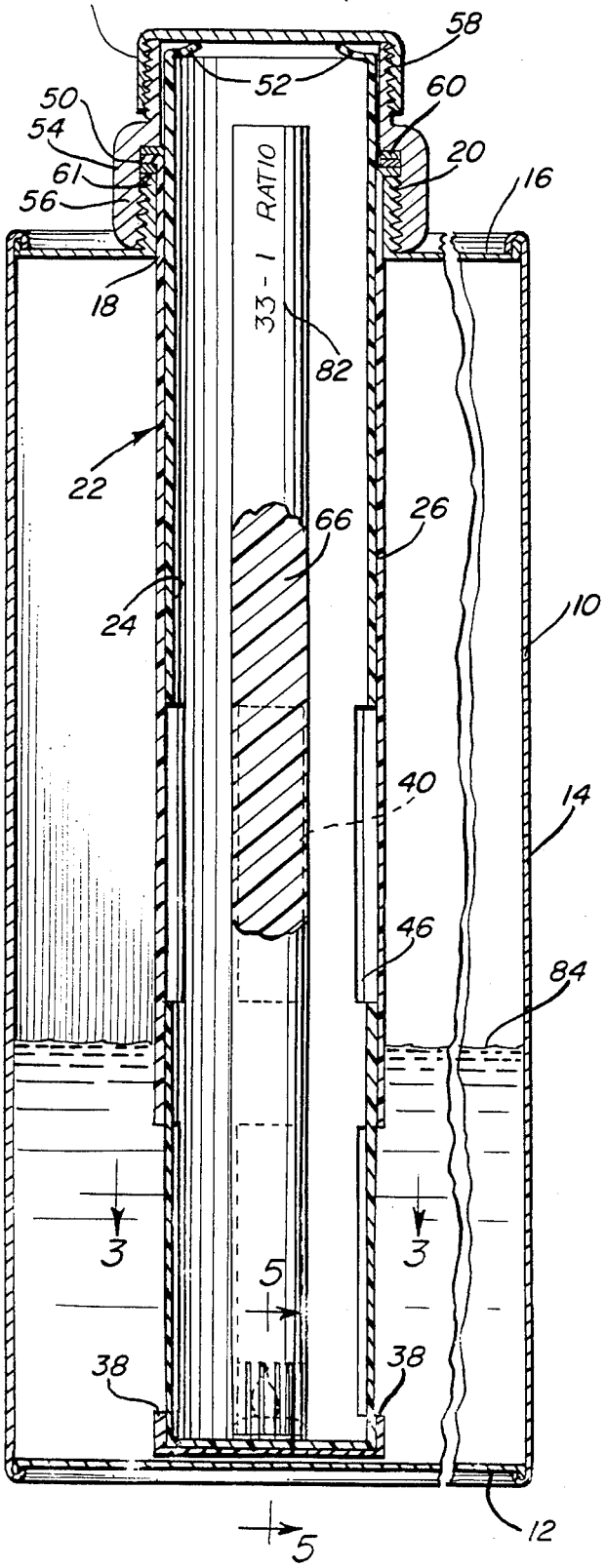
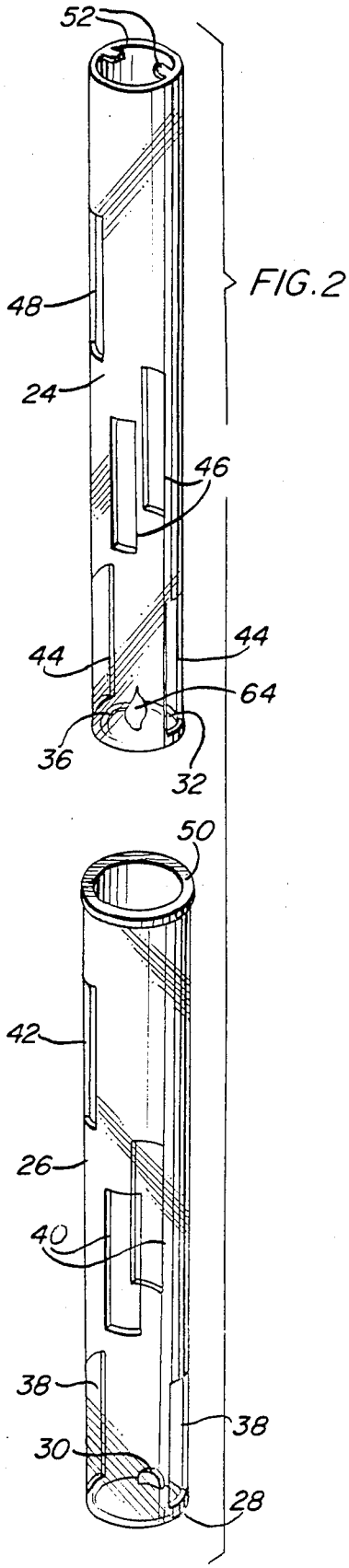

FIG. 7
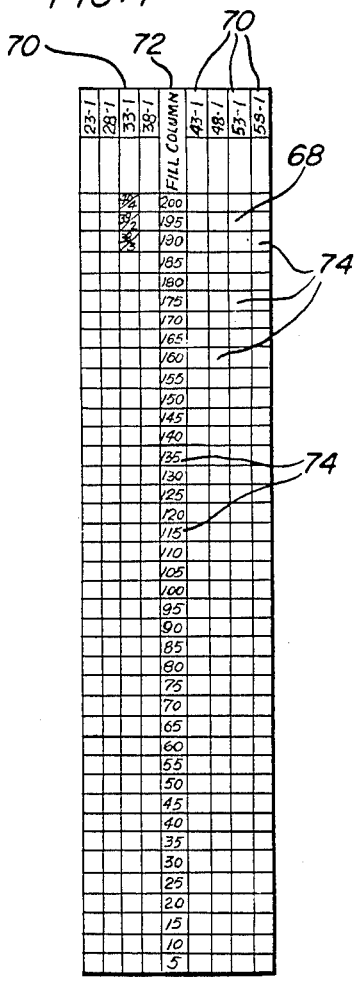
FIG. 8
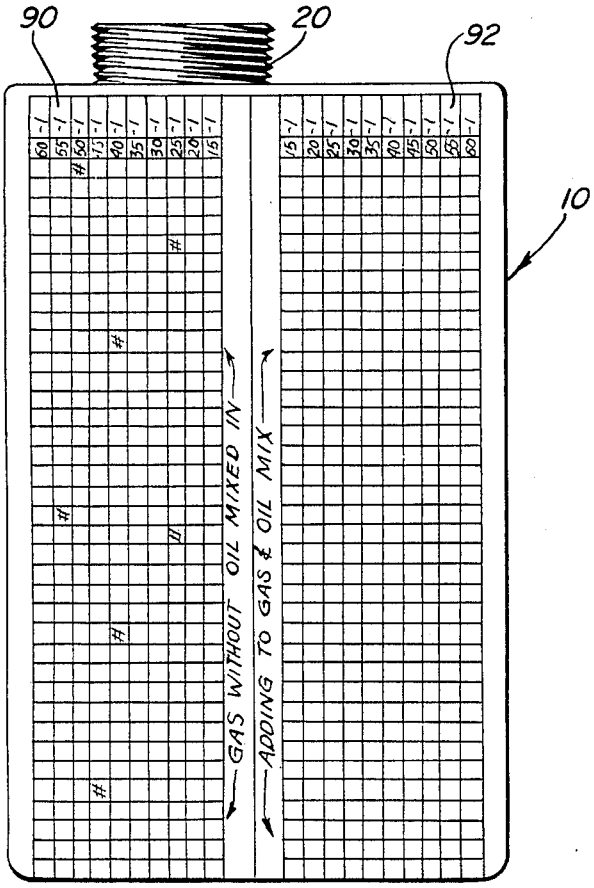
FIG. 9
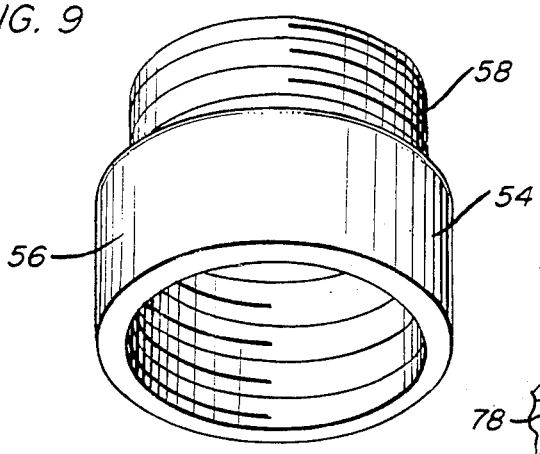
FIG. 10
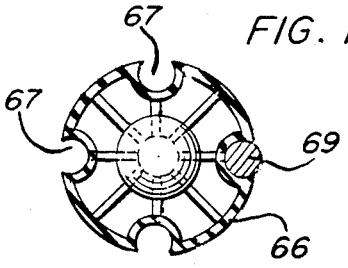
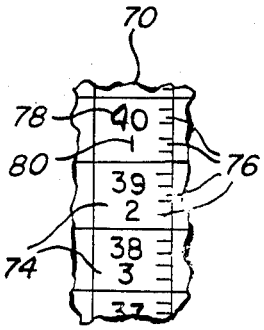
FIG. 11

RATIO MIX CONTAINER

BACKGROUND OF THE INVENTION

1. Field of the Invention

This invention relates to a container for a mixture of two different fluids and wherein a removable insert assembly is provided for the container to contain a small quantity of a first liquid for mixture with a larger quantity of a second liquid disposed in the container externally of the assembly, the assembly being constructed whereby the precise quantity of first liquid to be added to a mixture of the first and second liquids already in the container may be added to the assembly prior to filling of the remainder of the interior of the container with the second liquid in order to obtain a full container of the desired ratio of mixture of the first and second liquids.

2. Description of Related Art

Various different forms of ratio mix containers including some of the general structural and operational features of the instant invention heretofore have been provided such as those disclosed in U.S. Pat. Nos. 1,238,013, 2,631,608, 2,712,396, 3,948,105, 4,079,629, 4,135,404, 4,292,846, 4,480,470 and 4,549,585. However, while some of these ratio mix containers include structure whereby various different ratio mixes may be formed in a container, the instant invention includes structure by which different ratio mixes may be obtained in a full or partially filled container or added to an empty or partially filled container.

SUMMARY OF THE INVENTION

The container of the instant invention includes a top wall supporting a combined fill and pouring neck and a vertically elongated tubular assembly is removably downwardly insertable into the container through the neck and includes upper and lower end openings therein which may be selectively open and closed from the exterior of the container. In addition, the tubular assembly may downwardly receive a vertically elongated internal volume displacement member therein in order to vary the ratio mixture which may be accomplished by the assembly and the volume displacement member may itself include a plurality of areas thereof from which one or more additional smaller volume displacement members may be supported in order that the ratio mix capability of the combination of the assembly and the volume displacement member may be further expanded.

The main object of this invention is to provide a container in which a plurality of different ratio mixes of two liquids may be formed.

Another object of this invention, in accordance with the immediately preceding object, is provide a variable ratio mix container which will be capable of determining a proper amount of a small volume of a first liquid to be added to a partially filled container in order that a predetermined mix ratio may be formed by the subsequent filling of the container with a larger volume of a second liquid.

Yet another important object of this invention is to provide a ratio mix container in which a plurality of different ratio mixes of two liquids may be readily formed and added to the container for filling the same.

A further object of this invention is to provide a ratio mix container including a mixture ratio determining assembly including a plurality of relatively assembled components which may be readily disassembled for cleaning and varying the ratio mix to be formed.

A final object of this invention to be specifically enumerated herein is to provide a ratio mix container in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a fragmentary vertical sectional view of a ratio mix container constructed in accordance with the present invention and including a removable mix ratio determining assembly;

FIG. 2 is an exploded perspective view of the mix ratio determining assembly;

FIG. 7 is a plan view of a ratio mix chart which may be applied to the inner surface of a modified form of inner tube member such as that illustrated in the upper portion of FIG. 2 and equipped with mix openings on only one side thereof or which may be in part etched on the outer surface of the outer tube member illustrated in the lower portion of FIG. 2 and with the remainder of the chart etched on the inner tube member illustrated in the upper portion of FIG. 2 and with the chart portions registered with each other when the openings in the inner and outer tube member are closed relative to each other;

FIG. 8 is a side elevational view of a container constructed in accordance with the present invention including charts on the outer surface thereof enabling various ratio mixes of two liquids to be formed in the container;

FIG. 9 is an enlarged perspective view of the upper fitting portion of the container illustrated in FIG. 1;

FIG. 10 is an enlarged horiontal sectional view taken substantially upon the plane indicated by the section line 10—10 of FIG. 6; and FIG. 11 is a fragmentary view of a typical portions of the charts illustrated in FIG. 7.

DESCRIPTION OF THE PREFERRED EMBODIMENTS

Figure 3:
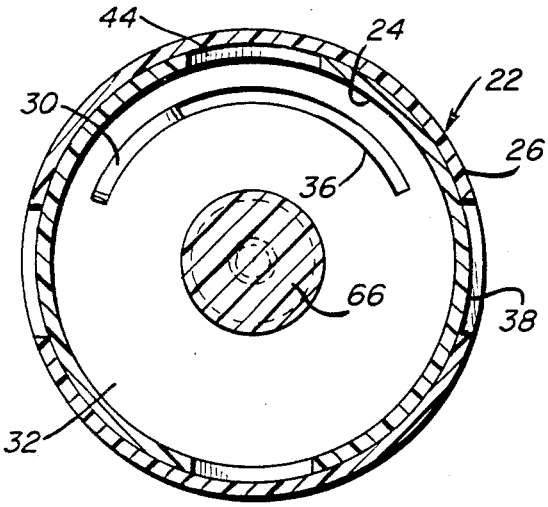
FIG. 3 is an enlarged horizontal sectional view taken substantially upon the plane indicated by the second line 3—3 of FIG. 1.
Figure 4:
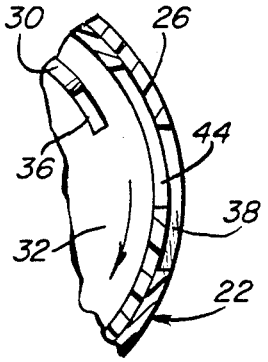
FIG. 4 is a fragmentary sectional view illustrated the right-hand portion of the structure illustrated in FIG. 3 and with the relatively rotatable portions of the structure in different positions of relative rotation from that shown in FIG. 3.
Figure 5:
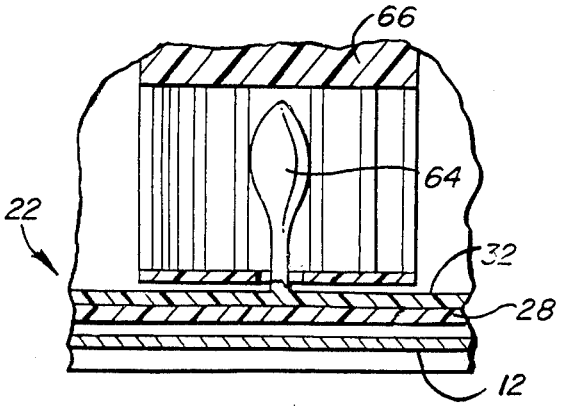
FIG. 5 is an enlarged fragmentary vertical sectional view taken substantially upon the plane indicated by the section line 5—5 of FIG. 1.

Referring now more specifically to the drawings, the numeral 10 generally designates an upright container including a bottom wall 12, an upstanding peripheral sidewall 14 and a top wall 16 having an opening 18 formed therein upwardly from which an externally threaded tubular neck 20 extends.

The container sidewall 14 may be opaque, translucent or transparent and an upstanding tubular assembly referred to in general by the reference numeral 22 is provided and is downwardly insertable into the container 10 through the tubular neck 20 with the upper portion of the assembly 22 projecting above the neck 20. The assembly 22 includes inner and outer cylindrical tubular members 24 and 26. The tubular member 26 includes an imperforate bottom wall 28 including an arcuate upstanding tang 30 supported therefrom and the tubular member 24 includes a bottom wall 32 having an arcuate slot 36 formed therein in which the tang 30 is slidingly received. The tubular members 24 and 26 are snugly telescopically engaged and relatively angularly and longitudinally displacement relative to each other, the opposite ends of the slot 36 establishing abutments engageable by the tang 30 to limit relative angular displacement of the tubular members 24 and 26.

The lower portion of the outer tubular member 26 includes a first pair of diametrically opposite openings 38 formed therein and the vertical mid-portion of the tubular member 26 includes a second pair of diametrically opposite openings 40 formed therein while the upper end of the outer tubular member 26 includes a single opening 42 formed therein. The inner tubular member 24 includes corresponding openings 44, 46 and 48, respectively, and the openings in the inner and outer tubular members 24 and 26 are registered with each other in one limit position of relative angular displacement of the tubular members 24 and 26 and out of registry with each other in the other limit position of relative angular displacement of the tubular members 24 and 26. The upper end of the outer tubular member 26 includes an outturned circumferential abutment flange 50 opposing the upper end of the tubular neck 20 and the upper end of the tubular member 24 includes diametrically opposite inwardly projecting tangs 52 for facilitation of angular displacement of the tubular member 24 relative to the tubular member 26 and also axial withdrawal of the tubular member 24 from the tubular member 26, the tubular member 24 being of greater vertical extent than the tubular member 26.

A tubular fitting 54 including an internally threaded large diameter lower end portion 56 and an externally threaded small diameter upper end portion 58 is removably threaded on the neck 20 and receives the flange 50 and upper and lower axially compressible and radially expandable sealing glands 60 and 61 therein. An internally threaded cap 62 is removably threaded on the small diameter end portion 58 and forms a fluid tight seal therewith.

The bottom wall 32 of the tubular member 24 includes an upwardly projecting bulbous enlargement 64 thereon and a volume displacement rod 66 is loosely and removably downwardly received in the inner tubular member 24 and includes a lower end removably snap-engageable over the enlargement 64.

FIG. 7 of the drawings illustrates a table 68 which may be etched in part on the inner surface of the inner tubular member 24 and in part on the outer surface of the outer tubular member 26 with the table 68 being viewable in the manner illustrated in FIG. 7 when the tubular members 24 and 26 are relatively rotated to the positions thereof with the various openings 38, 40, 42, and 44, 46, 48 closed. The table 68 includes two sets of opposite side vertical columns 70 and a central column 72 with each of the columns being divided into forty vertical spaces 74, each space 74 being subdivided into five levels 76, see FIG. 11. The columns 70 represent different ratio mixes and the column 72 represents a "fill column". The "fill column" spaces 74 include successive numbers descending by 5 from "200" to "5" and the spaces 74 of each of the column 70 each include upper and lower numbers 78 and 80 therein. For example, the upper number in the space 74 of the third column 70 from the left illustrated in FIG. 7 is "40" and the numbers descend downwardly to "1" and the lower numbers 80 in that column 70 ascend downwardly from "1" to "40".

The lower numbers 80 in the columns 70, see FIG. 11, are used when measuring the empty portion of the container above a gasoline and oil mixture therein. The upper members 78 in the columns 70, see FIG. 11, are used when determining how much oil to add when pure gasoline, for example, is in the can. In order to utilize the table 68, after the top 62 is removed the fitting 54 is removed so that the tubular members 24 and 26 may be removed. If the container 10 is empty and it is desired to fill the container with the desired ratio mix of gasoline and oil, the column 70 pertaining to the desired ratio is located and the upper numeral in the top space 70 of that column is noted. Then, that same number is located in the "fill column" 72. The tubular members are relatively rotated to positions with the openings therein closed and the inner tubular member 24 is filled to the noted number 76 in the "fill column" 72. Thereafter, the assembly 22 is placed within the container 10 and the tubular members 24 and 25 are relatively rotated in order to open the openings formed therein. Thereafter, the container 10 may be filled with gasoline through the assembly 22.

If pure gasoline is in the container to the level 84 in FIG. 1, the container 10 is held level and the assembly 22 is lowered into the container 10 with the openings in the tubular members 24 and 26 registered with each other. Then, the cylinders 24 and 26 are relatively rotated to entrap gasoline within the assembly 22 to a level corresponding to the level 84. Thereafter, the assembly 22 is elevated and the upper number 78 in the space 74 at the level of gasoline in the assembly 22 is noted. Then, the tubular members 24 and 26 are relatively rotated to open the openings and allow the gasoline to pass back into the interior of the container 10, after which the tubular members 22 and 24 are again relatively rotated to close the openings and oil is poured into the assembly 22 to the level of the upper number 78 noted in the column 70 on the column 72. Thereafter, with the assembly 22 again placed within the container 10, the tubular members 24 and 26 are relatively rotated to open the openings therein and thereby enable the gasoline and oil to be thorough mixed.

If the container 10 is filled, for example, with a 16-1 ratio of gasoline and oil mix to the level 84 illustrated in FIG. 1 and it is desired to fill the remainder of the container 10 with the same ratio mix, the assembly 20 is fully inserted in the container 10 and the level of the 16-1 ratio mixture entrapped therein, using the same procedure as described above when entrapping pure gasoline, is noted and the lower number 80 in space 74 at level 84 is used to determine the amount of oil required to obtain the desired 16-1 ratio, mix when the container thereafter is filled the remainder of the way with gasoline.

Inasmuch as the gland 60 is axially compressible and radially expandable, the fitting 54, when fully tightened, forms a fluid tight seal with the neck 20 and the assembly 22 thereby preventing leakage when the cap 62 is in the closed position. Further, when the cap 62 is removed, the fitting 54 may be loosened somewhat in order to allow the inner tubular member 24 to be partially extended upwardly relative to the fitting 54 in order to define a pouring spout. Then, the fitting 54 may again be tightened whereby the gland 60 will again form the desired fluid tight seal about the extended pouring spout.

The upper openings 42 and 48 serve not only to allow mixing of oil and gasoline within the container 10, but also as a vent for the upper portion of the interior of the container 10 when the latter is being filled with gasoline through the assembly 22.

With attention now invited more specifically to FIG. 8 of the drawings, it may be seen that the container 10 may be constructed of transparent or at least translucent material and have two tables 90 and 92 on its outer surface. The transparent or least translucent sidewalls of the container 10 illustrated in FIG. 8 permit a person to determine the level of liquid within the container 10 from the outside. In operation, the tables 90 and 92 each are similar to the tables 68 with the table 92 advising the amount of oil needed for mixing with the present gasoline and oil mix partially filling the container 10 in order to fill the remainder of the container with gasoline. The table 92 also may be used when the container is empty and table 90 determines the amount of oil to be added to pure gasoline within the container 10 for a desired mix ratio. When the container 10 in FIG. 8 is used, the attendant assembly 22 need only be provided with the fill column 72. Such an index principle also could be used in large tanks where site tubes are used to indicate quantities. Also, it is to be noted that other ratio mixes including mixes of a first quantity of liquid and second smaller quantity of liquid soluble solids also could be formed with the instant invention.

Figure 6:
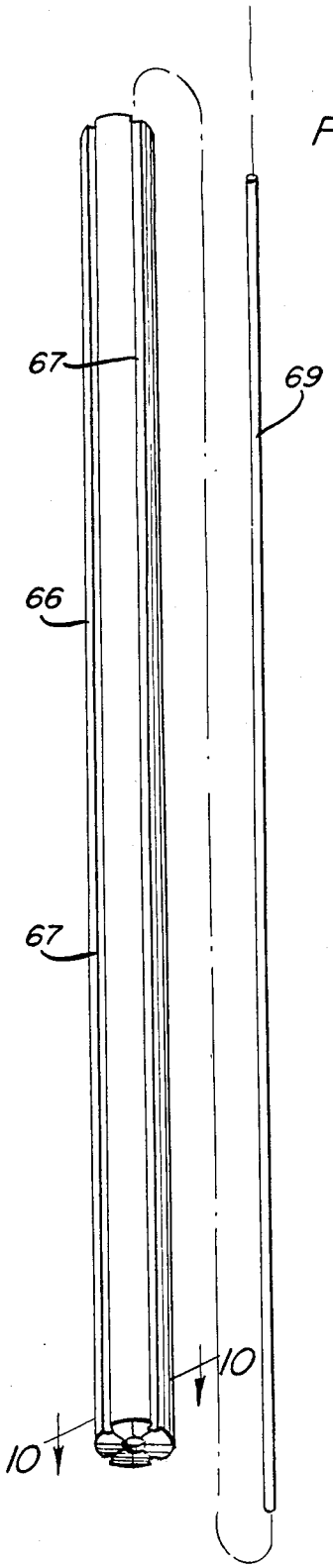
FIG. 6 is an exploded perspective view of a modified form of volume displacement assembly to be used in conjunction with the ratio mix container.

With attention now invited more specifically to FIGS. 6 and 10, there may be seen a modifiable volume displacement rod 66'. A plurality of different mix ratio rods 66 or 66' may be provided. Each rod 66', however, includes a plurality of circumferentially spaced grooves 67 in which smaller volume displacement rods 69 may be removably supported by snap-fitted engagement therein. The rods 66' for example, may be provided for establishing mix ratios of 30-1, 35-1, 40-1, 45-1 and 50-1. Therefore, if five rods are provided in conjunction with four rods 69, ratio mixes between 30-1 and 55-1 may be formed.

The snap-in volume displacement rod 66' may be provided in diameters corresponding to the more common gasoline/oil mix ratios desired.

If the container 10 is empty and a 30 to 1 gas to oil ratio is desired, the top 62 is removed from the container 10 and the assembly 22 is inserted downwardly through the neck 20 of the container 10. Thereafter, the fitting 54 is threadedly engaged over the neck 20 to lock down the assembly 22, the sealing glands 60 and 61 forming the necessary seals between the assembly 22 and the neck 20 and fitting 54.

Then, the 30 to 1 ratio volume displacement rod 66 is displaced downwardly into the assembly 22 and has its lower end portion snapped fitted over the bulbous enlargement 64. Then, the tubular members 22 and 24 are relatively turned to close the openings 38, 40, 42, 44, 46 and 48 therein. At this point, the interior of the container 22 represents 1/30 of the interior volume of container 22. By filling the assembly 22 to the top of the can with oil and then relatively rotating the cylinders in order to open the openings 38, 40, 42, 44, 46 and 48, an amount of oil is released into the interior of the container 10 to form the desired 30 to 1 ratio of mixture of gas and oil after the remainder of the interior of the container 10 is filled with gasoline.

Further, with attention invited more specifically to the use of the small displacement rods 69 in conjunction with the displacement rod 66', one or more rods 69 may be used in conjunction with a rod 66', in order to obtain mixes other than that provided by a rod 66', one or more rods 69 may be used in conjunction with a rod 66'. In order to obtain a 33-1 ratio mix, a 30-1 ratio mix rod 66' is used and three rods 69 are snap-supported in three corresponding grooves 67 in the rod 66'. Then, the rod 66' is used in the same manner as it otherwise would be used by itself.

If the gasoline/oil mix within the container 10 is consumed down to the level 84 and it was desired to refill the container with the same mix, the tubular members 24 and 26 are rotated to close the openings 38–48 thereby trapping a portion of the mix to the level 84 within the assembly 22. Then, the interior of the assembly 22 is again filled with oil, the tubular members 24 and 26 are rotated to open the openings 38–48 and the interior of the container is then filled with gasoline.

If, on the other hand, you have pure gasoline in the container to the level 84, the tubular members 24 and 26 may be rotated to positions opening the openings 38–48, the container 10 may be held horizontally in order to drain all of the gasoline out of the assembly 22 and the members 24 and 26 may then be rotated to close the openings 38–48. Then, with the interior of the assembly 22 held vertical and filled with oil to the level 84 of gasoline outside the assembly 22, the cylindrical members 24 and 26 are rotated to open the openings 38–48 and the container 10 may be shaken to thoroughly mix the oil and gasoline.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A variable ratio mix device including a container having an upwardly facing surface, a port in said upwardly facing surface, an upstanding, upwardly opening and open top hollow compartment assembly removably positionable within said container through said port and extending at least substantially the full height of said container therewithin below said port, said assembly defining upper and lower openings communicating the interior of said assembly with the upper and lower portions of the interior of said container exteriorly of said assembly and including closure means for selectively opening and closing said openings from exteriorly of said container, upstanding internal liquid volume displacement means insertable into and removable from the interior of said assembly and extending at least substantially the full height thereof within said container, the interiors of said compartment and said volume displacement means including corresponding height portions throughout substantially the full vertical extents thereof having at least substantially the same horizontal cross-sectional ratio.

2. The device of claim 1 wherein said compartment assembly includes inner and outer tube members relatively rotatable with each other and wherein each of said inner and outer tube members includes upper and lower openings formed therein, the openings in said inner and outer tube members being movable into and out of registry with each other responsive to relative rotation of said inner and outer tube members.

3. The device of claim 2 wherein said inner and outer tube members include coacting means limiting relative angular displacement of said inner and outer tube members between first limit positions with said openings of said inner and outer tube members registrable with each other and second limit positions with said openings of said inner and outer tube members out of registry with each other.

4. The device of claim 3 wherein said inner and outer tube members include bottom walls, the bottom wall of said inner tube member including a arcuate slot formed therein, the bottom wall of said outer tube member including an upstanding tang projecting into and slidable in said slot, said slot including opposite ends with which said tang is engageable comprising said means limiting said relative angular displacement of said tube members.

5. The device of claim 2 wherein said port is defined by an upwardly projecting externally threaded hollow fill neck carried by said upwardly facing surface, said outer tube member including outwardly projecting circumferential flange means downwardly abuttable against the upper end of said neck, a tubular fitting threaded on said neck and over said flange removably securing said outer tube member in said container, said fitting including axially compressible annular gland means overlying said flange and radially expandable into sealed engagement with the outer surface of said inner tube member.

6. The device of claim 1 including volume displacement means removably supported within and extending through substantially the full length of said inner tube member receivable in said container.

7. The device of claim 1 wherein said volume displacement means includes an upstanding rod-like member.

8. The device of claim 7 wherein said volume displacement means also includes at least one additional upstanding smaller cross-sectional area rod-like member removably supportable from the first mentioned rod-like member.

9. The device of claim 1 including vertically spaced indicia means on said assembly indicating descending volume amounts of a first liquid and ascending volume amounts of a second liquid to be received in said container to form a predetermined ratio mix of said liquids, said tubular members being constructed of transparent material.

10. The device of claim 1 wherein said container is constructed of light transmitting material for viewing the level of liquid therein from the exterior of said container, the exterior of said container including columns of vertically spaced indicia thereon indicating different ratio mixes of two fluids to be received in said container and with which the level of liquid mix in said container may be viewed from the exterior thereof, said assembly including a column of second indicia thereon, the columns of indicia on said container including first columns pertaining to a single liquid in said container and second columns pertaining to a mix of two liquids in said container, the indicia of said first and second columns each including indicia corresponding to said second indicia.

11. A variable ratio mix device including a container having an upwardly facing surface, a port in said upwardly facing surface, an upstanding, upwardly opening and open top hollow compartment assembly removably positionable within said container through said port and extending at least substantially the full height of said container therewithin below said port, said assembly defining upper and lower openings communicating the interior of said assembly with the upper and lower portions of the interior of said container exteriorly of said assembly and including closure means for selectively opening and closing said openings from exteriorly of said container, said compartment assembly including a pair of upstanding indicia scales of identical indicia inverted relative to each other.

12. The device of claim 11 including a third upstanding indicia scale on said container, said third indicia scale comprising an upwardly ascending numerical scale.

13. The device of claim 11 wherein said compartment assembly including at least one additional pair of upstanding indicia scales of identical indicia thereon inverted relative to each other and different from said first pair of indicia scales.

* * * * *